US008377857B2

(12) United States Patent
Chambard et al.

(10) Patent No.: US 8,377,857 B2
(45) Date of Patent: Feb. 19, 2013

(54) METHOD OF LUBRICATING A CROSSHEAD ENGINE

(75) Inventors: Laurent Chambard, Englewood, NJ (US); Laura Kosidowski, Marlborough (GB)

(73) Assignee: Infineum International Limited (GB)

( * ) Notice: Subject to any disclaimer, the term of this patent is extended or adjusted under 35 U.S.C. 154(b) by 1067 days.

(21) Appl. No.: 11/440,294

(22) Filed: May 24, 2006

(65) Prior Publication Data

US 2006/0270566 A1 Nov. 30, 2006

(30) Foreign Application Priority Data

May 27, 2005 (EP) ..... 05270018

(51) Int. Cl.
*C10M 141/00* (2006.01)

(52) U.S. Cl. ..... 508/192; 508/371; 508/391; 508/460; 508/586

(58) Field of Classification Search ..... 508/192, 508/460

See application file for complete search history.

(56) References Cited

U.S. PATENT DOCUMENTS

| | | | | |
|---|---|---|---|---|
| 3,852,204 | A * | 12/1974 | Souillard et al. | 508/295 |
| 4,358,385 | A * | 11/1982 | Zoleski et al. | 508/294 |
| 6,596,673 | B1 | 7/2003 | Bovington et al. | 508/437 |
| 2005/0003972 | A1 * | 1/2005 | Chambard et al. | 508/460 |

FOREIGN PATENT DOCUMENTS

| | | | |
|---|---|---|---|
| EP | 1 046 698 | A1 | 10/2000 |
| EP | 1 229 101 | A1 | 8/2002 |
| EP | 1 298 189 | A1 | 4/2003 |
| EP | 1 522 572 | A1 | 4/2005 |

* cited by examiner

*Primary Examiner* — Ellen McAvoy
*Assistant Examiner* — Vishal Vasisth

(57) ABSTRACT

A method of lubricating a cylinder liner and a crankcase in a marine diesel crosshead engine with the same lubricating oil composition. The lubricating oil composition has a TBN, as measured using ASTM D 2896-98, of 10 to 55 mg KOH/g. The lubricating oil composition comprises: at least 40 mass % of an oil of lubricating viscosity; at least one detergent; at least one dispersant; and at least one anti-wear additive.

11 Claims, No Drawings

METHOD OF LUBRICATING A CROSSHEAD ENGINE

The present invention relates to a method of lubricating a crosshead engine. In particular, the present invention relates to a method of lubricating a cylinder liner and a crankcase in a marine diesel crosshead engine with the same lubricant.

In a marine diesel crosshead engine the cylinder liner and the crankcase are lubricated separately using a cylinder oil and a system oil respectively. The cylinder oil lubricates the inner walls and the piston ring pack and controls corrosive and mechanical wear. The system oil lubricates the crankshaft and the crosshead; it lubricates the main bearings, the crosshead bearings, the camshaft and it cools the piston undercrown and protects the crankcase against corrosion. A typical cylinder oil has a viscosity at 100° C. of 19.0 cSt and a total base number of 70-100 mg KOH/g (ASTM D 2896-98); whereas a typical system oil has a viscosity at 100° C. of 11.5 cSt and a total base number of 5 mg KOH/g (ASTM D 2896-98). The use of two different oils means that a vessel operator needs to buy and store two different oils. Furthermore, a vessel operator needs to make sure that the right oil is used for the right part of the diesel engine. Therefore, it would be highly desirable if a cylinder liner and a crankcase could be lubricated using the same oil.

A system oil needs to be able to prevent corrosion of metal in the bearing shells and to prevent rust in the crankcase when in the presence of contaminated water. The system oil also needs to provide adequate hydrodynamic lubrication of the bearings and have an anti-wear system sufficient to provide wear protection to the bearings and gears under extreme pressure conditions. The cylinder lubricant, on the other hand, needs to be able to neutralize the acidic products of combustion, provide lubrication of the cylinder liners to prevent scuffing and be thermally stable in order that the lubricant does not form deposits on the piston ring pack.

The aim of the present invention is to provide a method of lubricating a cylinder liner and a crankcase in a marine diesel crosshead engine with the same lubricant. The lubricant would obviously need to provide sufficient lubrication for both the cylinder liner and the crankcase.

In accordance with the present invention there is provided a method of lubricating a cylinder liner and a crankcase in a marine diesel crosshead engine with the same lubricating oil composition; the lubricating oil composition comprising:

at least 40 mass % of an oil of lubricating viscosity;

at least one detergent;

at least one dispersant; and at least one anti-wear additive;

the lubricating oil composition having a TBN, as measured using ASTM D 2896-98, of 10 to 55, preferably 20 to 45, mg KOH/g.

The inventors have surprisingly found that they are able to lubricate both a cylinder liner and a crankcase in a marine diesel crosshead engine with the same lubricant. A vessel operator will therefore only need to have one tank of lubricant for the cylinder liner and the crankcase, which will improve logistics, cost and safety because there will not be any confusion between two oils. Furthermore, the invention makes it possible for engine manufacturers to redesign marine diesel crosshead engines so that the cylinder liner and the crankcase are lubricated by a single lubricant.

The lubricating oil composition preferably has a viscosity at 100° C. of 15 to 21 cSt.

The lubricating oil composition preferably includes at least one overbased hybrid/complex detergent including at least two surfactants selected from: phenol, sulphonic acid, salicylic acid and carboxylic acid. The lubricating oil composition preferably includes an overbased hybrid/complex detergent that is prepared from phenol, sulphonic acid and salicylic acid. The lubricating oil composition preferably also includes an overbased phenate detergent.

Marine diesel crosshead engines run on heavy fuel oil having sulphur levels ranging from 50 ppm to more than 4.0%.

Oil of Lubricating Viscosity

The oil of lubricating viscosity (sometimes referred to as lubricating oil) may be any oil suitable for the lubrication of a marine diesel crosshead engine. The lubricating oil may suitably be an animal, a vegetable or a mineral oil. Suitably the lubricating oil is a petroleum-derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tridecyl adipate, or polymeric hydrocarbon lubricating oils, for example liquid polyisobutene and poly-alpha olefins. Commonly, a mineral oil is employed. The lubricating oil may generally comprise greater than 60, typically greater than 70, mass % of the composition, and typically have a kinematic viscosity at 100° C. of from 2 to 40, for example for 3 to 15, $mm^2s^{-1}$ and a viscosity index of from 80 to 100, for example from 90 to 95.

Another class of lubricating oils is hydrocracked oils, where the refining process further breaks down the middle and heavy distillate fractions in the presence of hydrogen at high temperatures and moderate pressures. Hydrocracked oils typically have a kinematic viscosity at 100° C. of from 2 to 40, for example from 3 to 15, $mm^2s^{-1}$ and a viscosity index typically in the range of from 100 to 110, for example from 105 to 108.

The term 'brightstock' as used herein refers to base oils which are solvent-extracted, de-asphalted products from vacuum residuum generally having a kinematic viscosity at 100° C. of from 28 to 36 $mm^2s^{-1}$ and are typically used in a proportion of less than 30, preferably less than 20, more preferably less than 15, most preferably less than 10, such as less than 5, mass %, based on the mass of the composition.

Most preferably, the oil of lubricating viscosity is present in the lubricating oil composition in an amount greater than 50 mass %, more preferably greater than 60 mass %, based on the mass of the lubricating oil composition.

Detergents

The lubricating oil composition includes at least one detergent. A detergent is an additive that reduces formation of piston deposits, for example high-temperature varnish and lacquer deposits, in engines; it has acid-neutralizing properties and is capable of keeping finely divided solids in suspension. It is based on metal "soaps", that is metal salts of acidic organic compounds, sometimes referred to as surfactants.

The detergent comprises a polar head with a long hydrophobic tail. The polar head comprises a metal salt of a surfactant. Large amounts of a metal base are included by reacting an excess of a metal compound, such as an oxide or hydroxide, with an acidic gas such as carbon dioxide to give an overbased detergent which comprises neutralized detergent as the outer layer of a metal base (e.g. carbonate) micelle.

The metal may be an alkali or alkaline earth metal such as, for example, sodium, potassium, lithium, calcium, barium and magnesium. Calcium is preferred.

The surfactant may be a salicylate, a sulphonate, a carboxylate, a phenate, a thiophosphate or a naphthenate. Metal salicylate is the preferred metal salt.

The detergent may be a complex/hybrid detergent prepared from a mixture of more than one metal surfactant, such as a calcium alkyl phenate and a calcium alkyl salicylate. Such a complex detergent is a hybrid material in which the surfactant groups, for example phenate and salicylate, are incorporated during the overbasing process. Examples of complex detergents are described in the art (see, for example, WO 97/46643, WO 97/46644, WO 97/46645, WO 97/46646 and WO 97/46647).

The lubricating oil composition preferably includes at least one overbased hybrid/complex detergent including at least two surfactants selected from: phenol, sulphonic acid, salicylic acid and carboxylic acid. The lubricating oil composition preferably includes an overbased hybrid/complex detergent that is prepared from phenol, sulphonic acid and salicylic acid. The lubricating oil composition preferably also includes an overbased phenate detergent.

Surfactants for the surfactant system of the metal detergents contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impact the desired oil-solubility. Advantageously the alkyl groups include from 5 to 100, preferably from 9 to 30, more preferably 14 to 20, carbon atoms. Where there is more than one alkyl group, the average number of carbon atoms in all of the alkyl groups is preferably at least 9 to ensure adequate oil-solubility.

The detergents may be non-sulphurized or sulphurized, and may be chemically modified and/or contain additional substituents. Suitable sulphurizing processes are well known to those skilled in the art.

The detergents may be borated, using borating processes well known to those skilled in the art.

The detergents preferably have a TBN of 50 to 500, preferably 100 to 400, and more preferably 150 to 350.

The detergents may be used in a proportion in the range of 0.5 to 30, preferably 2 to 20, or more preferably 5 to 19, mass % based on the mass of the lubricating oil composition.

Dispersants

The lubricating oil composition includes at least one dispersant. A dispersant is an additive for a lubricating composition whose primary function in lubricants is to accelerate neutralization of acids by the detergent system.

A noteworthy class of dispersants are "ashless", meaning a non-metallic organic material that forms substantially no ash on combustion, in contrast to metal-containing, hence ash-forming, materials. Ashless dispersants comprise a long chain hydrocarbon with a polar head, the polarity being derived from inclusion of, e.g., an O, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed.

Examples of ashless dispersants are succinimides, e.g. polyisobutene succinic anhydride; and polyamine condensation products that may be borated or unborated.

The dispersants may be used in a proportion in the range of 0 to 10.0, preferably 0.5 to 6.0, or more preferably 1.0 to 5.0, mass % based on the mass of the lubricating oil composition.

Antiwear Additives

The lubricating oil composition includes at least one antiwear additive. Dihydrocarbyl dithiophosphate metal salts constitute a known class of anti-wear additive. The metal in the dihydrocarbyl dithiophosphate metal may be an alkali or alkaline earth metal, or aluminium, lead, tin, molybdenum, manganese, nickel or copper. Zinc salts are preferred, preferably in the range of 0.1 to 1.5, preferably 0.5 to 1.3, mass %, based upon the total mass of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared comprising both hydrocarbyl groups that are entirely secondary in character and hydrocarbyl groups that are entirely primary in character. To make the zinc salt, any basic or neutral zinc compound may be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil-soluble salts of dihydrocarbyl dithiophosphoric acids and may be represented by the following formula:

$$[(RO)(R^1O)P(S)S]_2Zn$$

where R and $R^1$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and $R^1$ groups are alkyl groups of 2 to 8 carbon atoms. Thus, the radicals may, for example, be ethyl, n-propyl, I-propyl, n-butyl, I-butyl, sec-butyl, amyl, n-hexyl, I-hexyl, n-octyl, decyl, dodecyl, octadecyl, 2-ethylehexyl, phenyl, butylphenyl, cyclohexyl, methylcyclopentyl, propenyl, butenyl. In order to obtain oil-solubility, the total number of carbon atoms (i.e. in R and $R^1$) in the dithiophosphoric acid will generally be 5 or greater. The zinc dihydrocarbyl dithiophosphate can therefore comprise zinc dialkyl dithiophosphates.

The antiwear additive may be used in a proportion in the range of 0.1 to 1.5, preferably 0.2 to 1.3, or more preferably 0.3 to 0.8, mass % based on the mass of the lubricating oil composition.

It may be desirable, although not essential, to prepare one or more additive packages or concentrates comprising the additive or additives, which can be added simultaneously to the oil of lubricating viscosity (or base oil) to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricant. The additive package may contain active ingredients in an amount, based on the additive package, of, for example, from 2.5 to 90, preferably from 5 to 75, most preferably from 8 to 60, mass % of additives in the appropriate proportions, the remainder being base oil.

The final formulations may typically contain about 5 to 40 mass % of the additive packages(s), the remainder being base oil.

The term 'active ingredient' (a.i.) as used herein refers to the additive material that is not diluent.

The term 'oil-soluble' as used herein does not necessarily indicate that the compounds or additives are soluble in the base oil in all proportions. It does mean, however, that it is, for instance, soluble in oil to an extent sufficient to exert the intended effect in the environment in which the oil is employed. Moreover, the additional incorporation of other additives may also permit incorporation of higher levels of a particular additive, if desired.

The lubricant compositions of this invention comprise defined individual (i.e. separate) components that may or may not remain the same chemically before and after mixing.

The invention will now be described, by way of example only, with reference to the following examples:

EXAMPLES

The following lubricating oil composition was prepared:

| | Combined Cylinder Oil and System Oil |
|---|---|
| 350 BN Calcium Phenate/Sulphonate/Salicylate Complex detergent | 7.15 |
| 258 BN Calcium Phenate Detergent | 6.00 |
| Succinimide Dispersant | 2.00 |
| ZDDP Anti-wear Additive | 0.50 |
| Brightstock | 20.00 |
| SN150 Base Oil | 0.10 |
| SN600 Base Oil | 64.25 |

The lubricating oil composition was compared to a commercial system oil (Infineum M7040, available from Infineum UK Ltd) and a commercial cylinder oil (Infineum M7089, available from Infineum UK Ltd). The results are shown below:

| | Commercial System Oil (Infineum M7040) | Commercial Cylinder Oil (Infineum M7089) | Combined Cylinder Oil and System Oil |
|---|---|---|---|
| $Vk_{100}$, ASTM D445, cSt | 11.2 | 18.7 | 17.2 |
| Base Number, ASTM D 2896, mg.KOH/g | 5.5 | 74.1 | 42.9 |
| System Oil Properties | | | |
| Rust, ASTM D 655B (140 F/4 h), Pass or Fail | Pass | | Pass |
| Corrosion, Ball Rust Test (ASTM D6557), Average gray value | 113 | | 122 |
| FZG Wear Test (Procedure CEC L-07-A-95), Fail load stage | 11 | | 9 |
| Cylinder Oil Properties | | | |
| Corrosive Wear with High Sulphur Fuel in Bolnes Engine, Liner Wear Average/Microns | | 19 | 12 |
| High Temperature Scuffing Resistance, Temperature of Minimum Friction Coefficient, ° C. | | 270 | 338 |
| Panel Coker High Temperature Detergency Test, Merit Rating | | 4.34 | 5.06 |
| Panel Coker High Temperature Detergency Test, Mass of Deposits, mg | | 34.1 | 28.5 |
| Komatsu Hot Tube Test for High Temperature Resistance, 330° C., 16 hours, Average Tube Merit Rating | | 0.5 | 4.58 |

As shown in the Table above, the combined cylinder oil and system oil achieves either the same or better results than the commercial system oil for rust control and deposit control. It achieves a worse result for wear control, but the result is adequate. As also shown in the Table above, the combined cylinder oil and system oil achieves better results than the commercial cylinder oil for corrosive wear, high temperature resistance and deposit control. The combined cylinder oil and system oil is therefore suitable for use in both a cylinder and crankcase of a marine diesel crosshead engine.

The Bolnes Test uses a Bolnes crosshead engine (a single cylinder 2-stroke engine, the Bolnes 3DNL), calibrated and stabilized, operating on a fuel including about 3.5% sulphur. The Bolnes engine speed is 500 rpm with a lubricant feed rate of 1.00 g/kwh. Each lubricant composition is tested for 96 hours. The test conditions are designed to create corrosive wear of the cylinder liner over the time. Wear is measured in microns in specific calibrated places on the cylinder liner. The average recorded wear is reported. The lower the recorded result, the less wear on the cylinder liner.

It is noted that for the Bolnes test, the combined cylinder oil and system oil included a different basestock than that reported above. The basestock included 25.00% of brightstock, 0.10% of SN 150 and 59.50% of SN600; it had a viscosity at 100° C. of 17.78 cSt and a base number of 43.11 mgKOH/g.

The Panel Coker Test involves splashing a lubricating oil composition on to a heated test panel to see if the oil degrades and leaves any deposits that might affect engine performance. The test uses a panel coker tester (model PK-S) supplied by Yoshida Kagaku Kikai Co, Osaka, Japan. The test starts by heating the lubricating oil composition to a temperature of 1100° C. through an oil bath. A test panel made of aluminium alloy, which has been cleaned using acetone and heptane and weighed, is placed above the engine lubricating oil composition and heated to 320° C. using an electric heating element. When both temperatures have stabilised, a splasher splashes the gas engine lubricating oil composition on to the heated test panel in a discontinuous mode: the splasher splashes the oil for 15 seconds and then stops for 45 seconds. The discontinuous splashing takes place over 1 hour, after which the test is stopped, everything is allowed to cool down, and then the aluminium test panel is weighed and rated visually. The difference in weight of the aluminium test panel before and after the test, expressed in mg, is the weight of deposits. This test is used for simulating the ability of a lubricant composition to prevent deposit formation on pistons. The panel is also rated by an electronic optical rater using a Video-Cotateur from ADDS, for discolouration caused by the lubricant deposits. The higher the merit rating, the cleaner the panel.

The HFRR or High Frequency Reciprocating Rig Test is a computer-controlled reciprocating oscillatory friction and wear test system for the wear testing of lubricants under boundary lubrication conditions. An electromagnetic vibrator oscillates a steel ball over a small amplitude while pressing it with a load of 10ON against a stationary steel disk. The lower, fixed disc is heated electrically and is fixed below the lubricant under test. The temperature is ramped from 80° C. to 380° C. in 15 minutes. The friction coefficient is measured vs. temperature. The friction coefficient decreases with increase in temperature due to the viscosity decrease of the oil, until a temperature at which oil form breakdown begins. At this point, the friction coefficient begins to increase again. The temperature at which the friction coefficient is a minimum is measured; the higher this temperature, the better the oil is at protecting the cylinder liner against scuffing wear.

The Hot Tube Test evaluates the high temperature stability of a lubricant. Oil droplets are pushed up by air inside a heated narrow glass capillary tube and the thin film oxidative stability of the lubricant is measured by the degree of lacquer formation on the glass tube, the resulting colour of the tube being rated on a scale of 0-10. A rating of 0 refers to heavy deposit formation and a rating of 10 means a clean glass tube at the end of the test. The method is described in SAE paper 840262. The level of lacquer formation in the tube reflects the high temperature stability of the oil and its tendency during service to form deposits in high temperature areas of the engine.

What is claimed is:

1. A method of lubricating a cylinder liner and a crankcase in a marine diesel crosshead engine with the same lubricating oil composition, said method comprising lubricating each of said cylinder liner and said crankcase with a lubricating oil composition comprising:

at least 40 mass % of an oil of lubricating viscosity;

at least one detergent;

at least one dispersant; and at least one anti-wear additive;

the lubricating oil composition having a TBN, as measured using ASTM D 2896-98, of 10 to 55 mg KOH/g.

2. The method claimed in claim 1, wherein the lubricating oil composition has a TBN, as measured using ASTM D 2896-98, of 20 to 45.

3. The method claimed in claim 2, wherein the lubricating oil composition has a TBN, as measured using ASTM D 2896-98, of 30 to 45.

4. The method claimed in claim 3, wherein the lubricating oil composition has a TBN, as measured using ASTM D 2896-98, of 35 to 45.

5. The method as claimed in claim 1, wherein the detergent is a complex/hybrid detergent including surfactants selected from: phenol, sulphonic acid, salicylic acid and carboxylic acid.

6. The method as claimed in claim 5, wherein the detergent is a complex/hybrid detergent including phenol, sulphonic acid and salicylic acid.

7. The method as claimed in claim 1, wherein the lubricating oil composition includes a phenate detergent.

8. The method as claimed in claim 1, wherein the lubricating oil composition has a kinematic viscosity at 100° C. of 15 to 21 cSt.

9. The method as claimed in claim 8, wherein the lubricating oil composition has a kinematic viscosity at 100° C. of 16 to 18 cSt.

10. The method as claimed in claim 1, wherein the dispersant in the lubricating oil composition is an ashless succinimide.

11. The method as claimed in claim 1, wherein the anti-wear additive is a zinc dihydrocarbyl dithiophosphate.

* * * * *